United States Patent [19]

Wu

[11] Patent Number: 4,966,546

[45] Date of Patent: Oct. 30, 1990

[54] CONVECTIVE THERMOFORMING OVEN

[75] Inventor: Wen-Pao Wu, Pittsford, N.Y.

[73] Assignee: Mobil Oil Corporation, New York, N.Y.

[21] Appl. No.: 346,032

[22] Filed: May 1, 1989

[51] Int. Cl.[5] ..... F27B 9/04

[52] U.S. Cl. ..... 432/121; 432/152; 432/194

[58] Field of Search ..... 432/8, 19, 21, 121, 432/152, 199, 242, 120, 176, 185, 194; 126/21 A; 34/23, 155, 156

[56] References Cited

U.S. PATENT DOCUMENTS

| | | | |
|---|---|---|---|
| 2,517,024 | 8/1950 | Prescott et al. | 432/8 X |
| 2,908,235 | 10/1959 | Naylor et al. | 432/121 X |
| 3,041,736 | 7/1962 | Peterson et al. | 34/23 X |
| 3,410,541 | 11/1968 | Schmidt | 432/152 |
| 3,624,806 | 11/1971 | Lytzen | 432/152 X |
| 4,002,792 | 1/1977 | Petersen et al. | 428/310 |
| 4,207,058 | 6/1980 | Petersohn et al. | 432/72 X |
| 4,419,309 | 12/1983 | Krutchen | 264/53 |
| 4,484,561 | 11/1984 | Baggott et al. | 126/21 A |
| 4,485,059 | 11/1984 | Krutchen et al. | 432/59 X |

*Primary Examiner*—Albert J. Makay
*Assistant Examiner*—C. Kilner
*Attorney, Agent, or Firm*—Alexander J. McKillop; Charles J. Speciale; James P. O'Sullivan, Sr.

[57] ABSTRACT

A thermoforming oven for the convection heating of a continuous web of a thermoplastic foam or film material which is being advanced through the oven towards a thermoformer. Moreover, there is disclosed to a method for the improved and more uniform convective heating of a thermoplastic foam or film material which is advanced through a thermoforming oven. A counter-current flow of a gaseous heating medium is regulated and directed so as to impart the greatest degree of uniformity of temperature thereto during heating and blow-up to the thermoplastic material being advanced in an intermittent manner through the convective oven.

9 Claims, 1 Drawing Sheet

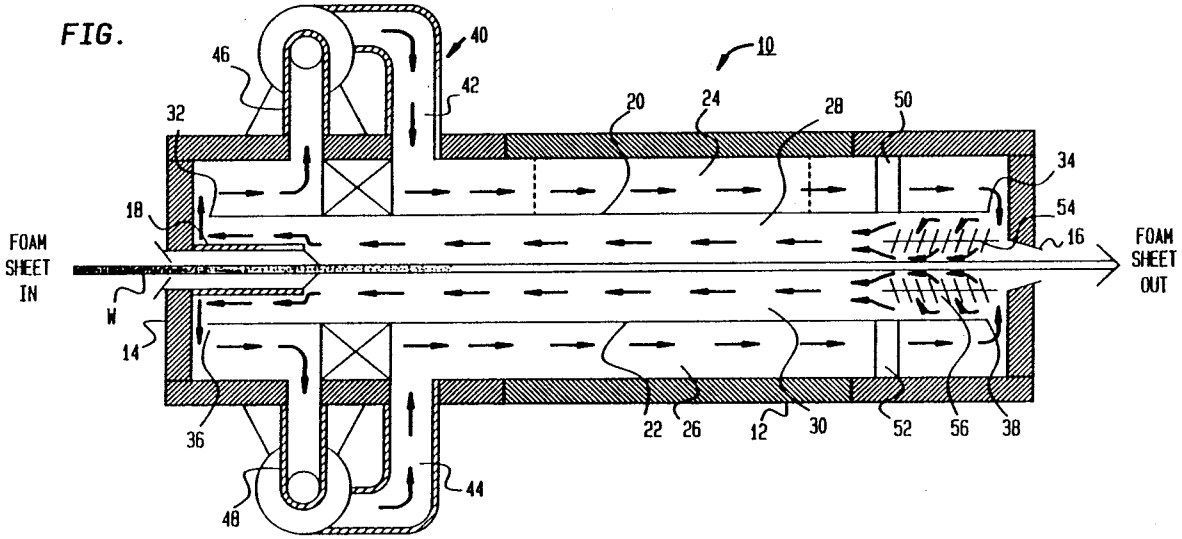
FIG.

CONVECTIVE THERMOFORMING OVEN

BACKGROUND OF THE INVENTION

1. Field of the Invention

The present invention relates to a thermoforming oven for the convective heating of a continuous web of a thermoplastic foam or film material which is being advanced through the oven towards a thermoformer. Moreover, the invention pertains to a method for the improved and more uniform convective heating of a thermoplastic foam or film material which is advanced through a thermoforming oven.

In the currently utilized technology pertaining to the thermoforming of plastic film or sheet materials, especially plastic foam sheet, wherein the most different and varied types of articles are molded into the film or foam sheet in a thermoformer, various kinds of ovens are employed for imparting the required heat to the film or foam sheet material prior to the latter being conveyed to the thermoformer. Thermoforming ovens which are presently in widespread commercial use are primarily of the radiant heat type, in which a plurality of heating devices producing radiant heat are interposed along the path of travel of the thermoplastic film or foam sheet material through the thermoforming oven, so as to thereby impart the desired amount of heat to the material and to cause it to expand to a controlled extent preceding the thermoforming operation. Because of encountered fluctuations or variations in the temperatures of the radiant heater components along the expanse of the oven, and the possible sagging of the film or foam sheet while being conducted through the oven, any thermoformer installations which normally incorporate thermoforming ovens containing radiant heaters generally fail to impart an adequate degree of heating uniformity to the film or sheet material. Consequently, the film or web material can shift internally within the confines or expanse of the advancing web in response to the variations in temperature encountered across the surface of the web or sheet, thereby adversely affecting the quality of any thermoformed articles produced therefrom. In order to improve upon the heating action of such thermoforming ovens containing radiant heaters, there have been contemplated utilizations of convective hot-air ovens in order to be able to achieve a more uniform temperature distribution over the surface of the film or foam sheet in the oven. The replacement of radiant heaters with an impinging hot-air flow of a convective hot-air oven has generally not been completely successful, inasmuch as the impinging hot air usually scorches the foam sheet or film when the web is intermittently stopped in its advance through the oven during molding cycles which are being implemented in the thermoformer.

Pursuant to a more recent development, instead of employing an impinging flow of hot air for heating the film material in a convective hot air oven, there has been employed the interaction of a flow pattern of a steam and air mixture and the thermoplastic foam sheet material. Although this essentially minimizes the previously encountered scorching of the sheet of plastic film as the latter is transported through the thermoforming oven; nevertheless, the large temperature drop which is generally encountered in such convective ovens limits the article-producing speed of the thermoforming cycle. The present invention overcomes this particular limitation by providing an internal recirculation system of a heating medium designed to produce a unique countercurrent flow of such medium in a convective thermoforming oven which, to a considerable degree, reduces the temperature drop of the impinging medium flow which is in contact with the surface of the intermittently advancing foam sheet material through the expedient aspect of heat conduction between the recirculating streams of the heating medium flow.

Consequently, in comparison with conventional heat ovens employing radiant heat, the convective thermoforming oven allows for the utilization of a method in the heating by a thermoforming oven of a thermoplastic sheet of film material, which imparts a much more uniform degree of heating to an intermittently advancing thermoplastic web, and with this resulting in a more consistent weight distribution within the material as the latter is advanced from the oven into the thermoformer.

Moreover, problems relative to surface scorching encountered by intermittently advanced webs of plastic sheet or film which, at times, render conventional hot air ovens unsuitable for thermoforming processes, are largely ameliorated or even completely eliminated, inasmuch as the countercurrent flow of a heating medium, such as but not necessarily a steam-air mixture, as described hereinbelow largely overcomes the disadvantages which are presently being encountered in the technology.

2. Discussion of the Prior Art

Krutchen, et al. U.S. Pat. No. 4,485,059, assigned to the common assignee of the present application, relates to a polymer foam thermoformation process and apparatus, in which the convection oven used in implementing the thermoforming method incorporates a steam and air flow at a predetermined temperature and to certain steam to air ratios. Although this considerably improves upon the heating operations of radiant heater-type thermoforming ovens, there is no disclosure of the countercurrent flow as is contemplated by the present invention and which provides for a more uniform heating of the intermittently advanced plastic film or foam material as the latter is transported through the thermoforming oven towards a molding station.

Assarsson, et al. U.S. Pat. No. 4,279,847 relates to a method and apparatus for the continuous manufacture of foamed plastic materials wherein a stream of heated air and water is impinged against the surface of an advancing foamable plastic material. Although this eliminates the drawbacks encountered in thermoforming ovens which are equipped with radiant heaters, there is no disclosure of employing a countercurrent flow of a heating medium in a convective thermoforming oven analogous to the invention which would impart a more uniform temperature distribution to a web of thermoplastic film during an intermittent advance thereof towards a thermoformer.

Holden U.S. Pat. No. 4,438,054, also assigned to the common assignee of the present application, describes a method and apparatus for measuring and controlling foam sheet blow-up in a thermoformer oven, wherein heaters contained in the oven are controlled so as to allow for the attainment of a more uniform material thickness upon exiting the oven and prior to the conveyance thereof into a molding or forming station. This particular publication also relates to the use of radiant heaters which may cause non-uniformities in heating during an intermittent advance of the plastic film or sheet towards a thermoforming station.

Various other kinds of apparatus and methods for the heating of thermoplastic film or plastic foam sheet materials are described in Schedel U.S. Pat. No. 4,539,167; Cannon, et al. U.S. Pat. No. 4,056,587; Jacobs, et al. U.S. Pat. No. 3,189,339; Carrigan, et al. U.S. Pat. No. 3,518,334; and O'Brien, et al. U.S. Pat. No. 3,359,600. However, none of these publications disclose the use of a countercurrent flow of a steam-air mixture to attain a more uniform degree of heating over the surfacer of the sheet of an intermittently advancing thermoplastic film or web as the latter is conducted through a convective oven towards a thermoforming apparatus.

SUMMARY OF THE INVENTION

In order to obviate or ameliorate the limitations and drawbacks in prior art thermoforming ovens, the present invention contemplates the provision of a novel convective thermoforming oven and method of utilization thereof in the heating of an intermittently advanced sheet of film or foam material, in which a countercurrent flow of a suitable heating medium is regulated and directed so as to impart the greatest degree of uniformity of temperature thereto during heating and blow-up to the thermoplastic material being advanced in an intermittent manner through the convective oven.

Accordingly, it is an object of the present invention to provide a novel convective thermoforming oven employing a countercurrent flow of a suitable heating medium, such as steam and air, hot air and/or carbon dioxide, or similar hot gas, for the more uniform heating and thermal expansion of an intermittently advancing web of a plastic foam sheet or film.

It is a more specific object of the present invention to provide a thermoforming oven of the type described herein, employing a countercurrent flow of a gaseous heating medium for balancing the heat in the oven, in which the thermoplastic foam sheet or film material is imparted a generally uniform degree of heating in a controlled manner over the surface thereof during its conveyance through the thermoforming oven.

Yet another object of the present invention resides in the provision of a novel method for the convective heating with a heating medium in countercurrent flow of a continuous web of a thermoplastic foam or film material being intermittently advanced through a thermoforming oven.

Still another object of the present invention is to provide a method for the convective heating of a continuous web of thermoplastic foam or film material, in which the web is subjected to a countercurrent flow of a gaseous heating medium, such as a steam and air mixture, hot air and/or carbon dioxide or the like, being recirculated within the thermoforming oven so as to considerably enhance the degree of uniformity of the heating and thermal expansion of the material prior to its advance into a thermoforming installation.

BRIEF DESCRIPTION OF THE DRAWING

Reference may now be had to the following detailed description of a preferred embodiment of a convective thermoforming oven employing a recirculating gaseous heating medium flow for heating a web of thermoplastic foam or film material in countercurrent flow during its conveyance through the oven, taken in conjunction with the accompanying single figure of drawing illustrating a longitudinal sectional view through the inventive thermoforming oven.

DETAILED DESCRIPTION

Referring now in detail to the single FIGURE of drawing, in a generally diagrammatic representation there is shown a convective thermoforming oven 10 which is employed for the convective heating of a continuous sheet or web W of a thermoplastic foam or film material. The web or sheet W of thermoplastic foam material is advanced along generally the longitudinal center of the oven 10, the latter of which comprises an elongate housing 12 having a web inlet end 14 and a web discharge end 16. At the inlet end 14 for the web W the housing 12 may be provided with a device 18 consisting of a shield which is adjustably extendable into the oven 10 so as to provide adjustment over the length of the interior space within the oven 10 to which the web W is exposed to the heating action of the heating medium within the thermoforming oven. Suitable devices such as rollers or various support members (not shown) may be provided to maintain the film web W in a generally lay-flat condition, as the film or web is advanced in usually an intermittent manner therethrough towards the discharge end 16 so as to be conducted towards a molding station or thermoformer (not shown) of conventional type, which is adapted to mold various kinds of articles into the heated and expanded web W, as is well known in the thermoforming technology.

The upper and lower spaces in the thermoforming oven which are present above and below the path of travel of the web W are divided through, respectively, an upper plate 20 and a lower plate 22 extending along the length of the oven into, essentially upper and lower outwardly located spaces 24 and 26, and inwardly located upper and lower spaces 28 and 30. These plates 20, 22 which each extend along substantially the entire length of the convective thermoformer oven 10 are constituted from a heat-conductive material, such as sheet metal. At the inlet and discharge ends of the plates 20 and 22, there are provided spaces 32 and 34 with regard to the end walls of the oven so as to connect both ends of the upper space 24 with the lower space 28 above the web W, and spaces 36 and 38 which connect the opposite ends of the inner space 30 with the outer space 26 below the path of travel of web W.

Proximate the web inlet end 14 of the thermoforming oven 10, the latter is provided with a blower and heater arrangement 40 which heats and discharges a flow of a gaseous heating medium at a predetermined and controllable temperature through a discharge conduit 42 into a region proximate the downstream end of the upper outer space 24; and which flow is then conducted from the downstream end of the thermoforming oven 10 towards the upstream end above the plate 20, whereas concurrently a similar flow of the heating medium is introduced through the discharge conduit 44 of the blower and heater arrangement 40 into the region proximate the downstream end of the lower outer space 26 and conducted towards the upstream end of the oven below plate 22. Preferably, the gaseous heating medium consists of heated air, although a steam-air mixture, or carbon dioxide which may be admixed with air if desired; or other suitable heating gases which are compatible with or unharmful to the material of the web, would also be expedient in connection with this invention. The flows of the heating medium from the downstream ends of the respective upper and lower outer spaces 24 and 26 are then conveyed through the respective spaces 34 and 38 into the upper and lower inner spaces 28 and space 30 so as to be conveyed in a countercurrent flow relative to the direction of advance of the web W back towards the inlet end of the thermoforming oven 10.

The flows of the heating medium within the upper and lower inwardly located spaces 28 and 30 are then respectively conducted through the spaces 32 and 36 back towards return conduits 46 and 48 of the blower and heater arrangement 40 and reheated and recycled prior to being recirculated into the spaces 24 and 26 of thermoforming oven 10 through the discharge conduits 42 and 44. This will impart a continuous countercurrent flow with the web W and recirculation of the heating medium. Moreover, the contacting of the opposite sides of the respective plates 20 and 22 by the counter-flowing medium will cause the flows of the heating medium on both sides thereof which are two different temperatures to become more uniformly balanced through the conduction of heat through the plates 20, 22, imparting a greater degree of uniformity of heat along the length of the film or web W as the latter is advanced from the inlet end towards the discharge end of the oven. In addition to the foregoing, the heat transfer between the flows of the heating medium streaming in opposite directions on both sides of the respective plates 20 and 22 may be further enhanced by providing perforations through each of the plates. These perforations are expediently distributed over the surfaces of the plates intermediate the blower and heater arrangement 40 and the downstream end of the plates at spaces 34 and 38.

In order to further enhance the equalized distribution of the steam and air mixture over the upper and lower web surfaces, proximate the downstream ends of the respective outward upper and lower flow spaces 24 and 26 in the oven, there may be provided a flow diverter system 50 and 52 consisting of suitable baffles diverting some of the flow of the steam-air mixture in a transverse or lateral direction so as to produce a more uniform heat distribution across the width of the plates.

Similarly, the inward upper and lower spaces 28 and 30, proximate the downstream end of the thermoforming oven 10, may each be provided with a further flow distribution grid arrangement 54 and 56, each receiving flow of heating medium through the respective spaces 34 and 38, which will facilitate an enhanced distribution of the steam and air mixture in the machine direction of the web generally opposite to the direction of advance of the web W so as to again enhance the countercurrent flow of the air and steam mixture within the spaces 28 and 30 relative to the web surfaces, thereby again improving upon the uniformity in the temperature distribution.

From the foregoing it become readily apparent to one skilled in the art that the inventive thermoforming oven and method for the convective heating of a thermoplastic foam web or film material which is intermittently advanced through the oven towards a thermoformer, significantly reduces the temperature gradient encountered along the longitudinal direction of advance of the web material through the thermoforming oven, thereby considerably enhancing the uniformity of heating and blow-up of the film or foam material, and reducing the danger of burning or scorching the surface of the web which would adversely affect the properties of the film and any articles molded therefrom.

While there has been shown and described what is considered to be a preferred embodiment of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. An oven system for the convective heating of a continuous web of a member selected from the group consisting of a thermoformable foam sheet and thermoformable film material comprising in combination:

(a) a convection heating oven having an inlet and an outlet end;

(b) a continuous supply of said thermoformable web and means for transporting said web through said oven in a continuous or intermittent manner;

(c) a source of heated gaseous medium and conveying means for exposing said web to said heated medium;

said oven including a first longitudinally extending plate on one side of said web, said first plate forming a first space between said first plate and a wall of said oven and a second space between said first plate and said web, said second space being in communication with said first space at said inlet and outlet ends; a second longitudinally extending plate on the other side of said web, said second plate forming a third space between said second plate and another wall of said oven and a fourth space between said second plate and the other side of said web, said fourth space being in communication with said third space at said inlet and outlet ends; and said heating medium conveying means being adapted to convey said medium through said first and third spaces in the direction of transport of said web through said oven and recirculating said medium through said second and fourth spaces in a flow along the surfaces of said web countercurrent to the direction of transport of said web.

2. The system of claim 1 wherein said flow conveying means comprises blower and heater means for introducing said heating medium proximate the oven inlet and into said first and third spaces and subsequently into the second and fourth spaces in a recirculating mode.

3. The system of claim 1 including baffle means in said first and third spaces proximate said oven outlet for distribution of said heated medium in a transverse direction over the surfaces of said plates facing said spaces.

4. The system of claim 1 comprising means for varying the effective length of the web being contacted by said heated medium in said oven.

5. The system of claim 1 wherein said plates are of a comparatively good temperature-conducting material.

6. The system of claim 5 wherein said plates are of sheetmetal.

7. The system of claim 6 wherein said sheetmetal plates are perforated to an extent sufficient to enhance the transfer of heat from one side thereof to the other.

8. The system of claim 1 comprising means in said second and fourth spaces proximate the oven outlet end for redirecting and distributing the flows of said heated medium toward the web surfaces in countercurrent flow with the direction of the advance of said web.

9. The system of claim 1 wherein said heated medium is a member of the group consisting of air, an air and steam mixture, carbon dioxide, a carbon dioxide and air mixture, and any combination thereof.

* * * * *